US011731300B2

(12) United States Patent
Lülfing et al.

(10) Patent No.: US 11,731,300 B2
(45) Date of Patent: Aug. 22, 2023

(54) BELT CUTTER

(71) Applicant: SafeWorks, LLC, Tukwila, WA (US)

(72) Inventors: Frank Lülfing, Wietze (DE); Viatcheslav Maik Seibel, Bremen (DE)

(73) Assignee: SafeWorks, LLC, Tukwila, WA (US)

( * ) Notice: Subject to any disclaimer, the term of this patent is extended or adjusted under 35 U.S.C. 154(b) by 0 days.

(21) Appl. No.: 16/461,254

(22) PCT Filed: Nov. 14, 2017

(86) PCT No.: PCT/US2017/061512
§ 371 (c)(1),
(2) Date: May 15, 2019

(87) PCT Pub. No.: WO2018/093768
PCT Pub. Date: May 24, 2018

(65) Prior Publication Data

US 2019/0275689 A1 Sep. 12, 2019

Related U.S. Application Data

(60) Provisional application No. 62/422,522, filed on Nov. 15, 2016.

(51) Int. Cl.
*B26D 1/08* (2006.01)
*B26D 5/02* (2006.01)
*B26D 3/00* (2006.01)

(52) U.S. Cl.
CPC ..... *B26D 1/08* (2013.01); *B26D 3/003* (2013.01); *B26D 5/02* (2013.01)

(58) Field of Classification Search
CPC ... B26D 1/08; B26D 1/04; B26D 5/02; B26D 5/14; B26D 3/003; B21D 28/243
(Continued)

(56) References Cited

U.S. PATENT DOCUMENTS 119,827 A * 10/1871 Cowles ..... B23D 33/08 83/384
237,178 A * 2/1881 Goss ..... B23Q 5/045 408/102

(Continued)

FOREIGN PATENT DOCUMENTS

CN 1210779 A 3/1999
CN 1241959 A 1/2000

(Continued)

OTHER PUBLICATIONS

International Patent Application No. PCT/US2017/061512; Int'l Written Opinion and Search Report; dated Feb. 16, 2018; 9 pages.

(Continued)

*Primary Examiner* — Nhat Chieu Q Do
(74) *Attorney, Agent, or Firm* — Foley & Lardner LLP

(57) ABSTRACT

A portable belt cutting device comprises a cutting head and a cutting blade movably arranged on the cutting head. The cutting head has a drive mechanism to move the blade from a retracted position to an extended position, such that the blade severs a belt. The drive mechanism is coupled to the blade such that the blade is actively driven in both directions between the retracted position and the extended position. In some embodiments, the drive mechanism comprises a drive spindle which engages a thread formed in the cutting head. The spindle is bi-directionally movable and comprises a torque input geometry. In another embodiment the drive spindle and blade comprise connecting elements that form a positive connection when engaged.

12 Claims, 3 Drawing Sheets

(58) Field of Classification Search
USPC ..... 83/631, 635–636, 694, 389, 384
See application file for complete search history.

(56) References Cited

U.S. PATENT DOCUMENTS 429,701 A * 6/1890 Parmelee ..... B30B 1/18 72/454
1,419,789 A * 6/1922 Webb ..... B23D 15/14 83/554
2,202,514 A * 5/1940 Benner ..... E01B 31/06 30/361
2,351,435 A * 6/1944 Kent ..... B26F 1/3866 408/138
2,837,767 A * 6/1958 MacDonald ..... B29C 73/305 425/13
3,376,728 A * 4/1968 Nemessanyi ..... B30B 1/18 72/454
4,244,255 A * 1/1981 Dykstra ..... B26D 5/10 83/629
4,581,825 A * 4/1986 Parton ..... B21L 9/04 30/358
4,587,737 A * 5/1986 Wilson ..... B21D 28/34 30/358
5,634,387 A * 6/1997 Squires ..... B23D 15/06 83/468
5,669,296 A * 9/1997 Newton ..... B30B 1/18 100/231
5,996,459 A 12/1999 Cornell et al.
6,152,007 A * 11/2000 Sato ..... B26D 1/0006 83/202
7,000,521 B1 * 2/2006 Cheng ..... B26D 1/08 83/631
7,249,551 B1 * 7/2007 Ray ..... B26D 5/10 30/178
8,020,478 B2 9/2011 Cheng
2010/0089217 A1 4/2010 Cheng
2010/0124595 A1 * 5/2010 Pattenden ..... B26F 1/16 426/518
2011/0095150 A1 * 4/2011 Geier ..... F16M 11/048 248/220.22
2012/0165107 A1 * 6/2012 Guo ..... F16B 23/003 470/57
2013/0205958 A1 8/2013 Wouteres et al.
2016/0245325 A1 * 8/2016 Chen ..... B25B 15/005
2017/0095909 A1 * 4/2017 Chen ..... F16B 23/0038
2017/0138386 A1 * 5/2017 Hsu ..... F16B 23/0038
2017/0190029 A1 * 7/2017 Cuesta ..... B25B 23/0028
2018/0116814 A1 * 5/2018 Sullivan ..... A61B 17/864
2019/0275691 A1 * 9/2019 Wang ..... B23D 21/04

FOREIGN PATENT DOCUMENTS

CN 201702793 U 1/2011
CN 202318399 U 7/2012
CN 202556458 U 11/2012
CN 204194917 U 3/2015
CN 205201681 U 5/2016
CN 205219191 U 5/2016
CN 105666540 A 6/2016
CN 205310339 U 6/2016
CN 205398657 U 7/2016
CN 205674266 U 11/2016
EP 2631045 A1 8/2013
GB 1131567 A 10/1968
JP H07-000269 U 1/1995
WO WO 2016/164139 A1 10/2016

OTHER PUBLICATIONS

International Patent Application No. PCT/US2017/061512; Int'l Preliminary Report on Patentability; dated Nov. 15, 2018; 13 pages.

* cited by examiner

BELT CUTTER

CROSS-REFERENCE TO RELATED APPLICATIONS

This application claims priority to PCT Application No. PCT/US2017/061512, filed Nov. 14, 2017, which claims benefits from the priority of U.S. application Ser. No. 62/422,522, filed Nov. 15, 2016, and entitled "BELT CUTTER" the entire contents of which are hereby incorporated by reference.

SUMMARY

Belt cutters may be used for cutting belts such as flat belts and flat belts having a wire reinforcement. A belt cutter may have a drive mechanism that actively drives a cutting blade from a retracted position into an extended position, cutting the belt along the way. Drive mechanisms may have pneumatic or hydraulic plungers that are coupled to the blade. The blade in turn may be coupled to a resilient member such as a helical spring, against the resilient force of which the blade is actuated by the driving mechanism. After cutting is completed, the resilient force stored in the spring may be used to move the blade back towards the retracted position. This may be referred to as a passive drive mechanism. One use with such systems is that the blade may get stuck, e.g., due to friction against the cut belt, particles of the belt that may have come loose during cutting, etc. In such cases the spring force may be insufficient to reliably move the blade all the way back into the retracted position.

Described herein is a portable belt cutting device, which may be usable in some embodiments for cutting wire-reinforced flat belts. In one embodiment, the portable belt cutting device may have a cutting head, a cutting blade that is moveably arranged on the cutting head and supported by the cutting head such that the blade is moveable between a retracted position and an extended position. The cutting head may comprise a drive mechanism for moving the blade from the retracted position towards the extended position, in which position the blade may sever the belt. The drive mechanism may be coupled to the blade such that the blade is actively driven to move in both directions between the retracted position and the extended position. The bi-directional drive may thus provide an active driving force not only to cut the belt, but also to return the blade to the retracted position. If the blade tends to get stuck, the driving force may be increased as required until the blade moves back into the retracted position.

In one embodiment, the drive mechanism comprises a connecting element, and the blade comprises a correspondingly shaped connecting element, wherein the connecting elements form a positive connection with each other when engaged. The drive mechanism may comprise a drive spindle, wherein the connecting element of the drive mechanism is formed on an end portion of the drive spindle.

In an embodiment, the drive spindle may engage a thread formed in the cutting head. The spindle may be bi-directionally moveable relative to the thread. The drive spindle may comprise a second end portion opposite of the first end portion, and the second end portion may comprise a torque input geometry.

In some embodiments, the torque input geometry may be formed as a polygonal recess or polygonal projection. The recess or projection may be formed to accept correspondingly shaped male or female tools for applying torque, in particular in both rotational directions.

In another embodiment, the torque input geometry may be formed as a male or female Torx profile or Torx plus profile.

In an embodiment, the blade may comprise a front side and an opposite back side, and the cutting device may comprise a first stationary edge located adjacent the front side of the blade. Additionally, the cutting device may comprise a second stationary edge located adjacent the back side of the blade. The stationary edges may provide an abutment for the belt.

The cutting device may comprise a cutting base, the cutting head being mounted to the cutting base. The cutting base may comprise a slit which is dimensioned to allow the cutting blade to pass through when moving between the retracted position and the extended position. The first and second stationary edges may be opposite longitudinal edges of the slit.

The cutting head may be pivotably mounted to the cutting base, and may further be pivotably moveable between an open position and a closed position.

In another embodiment, the cutting device may comprise a locking unit for securing the cutting head to the cutting base when pivoted into the closed position.

The locking unit may comprise a locking pin mounted to the cutting base. The cutting head may comprise a recess that is dimensioned to accept the locking pin when in the closed position.

In various embodiments, the cutting device may comprise a handle.

The handle portion may be mounted to the cutting base. The handle may comprise an elongate portion extending away from the cutting base.

The blade may comprise at least one cutting edge. The cutting edge may be oriented non-perpendicularly to the direction of movement of the cutting blade between the retracted position and the extended position.

The blade may comprise a first blade section and a second blade section. The first and second blade sections may be angled opposite to one another. The cutting blade may comprise a first lateral side and a second lateral side opposite the first lateral side, and a center portion extending between the first and second lateral sides. The first and second blade sections may project further towards the extended position at the lateral sides than in the center portion such that upon contact between belt and blade, the belt is cut from its periphery towards its center.

BRIEF DESCRIPTION OF THE FIGURES

Hereinafter, a preferred embodiment of the invention is described in greater detail with reference to the accompanying drawings.

DETAILED DESCRIPTION

Figure 1:
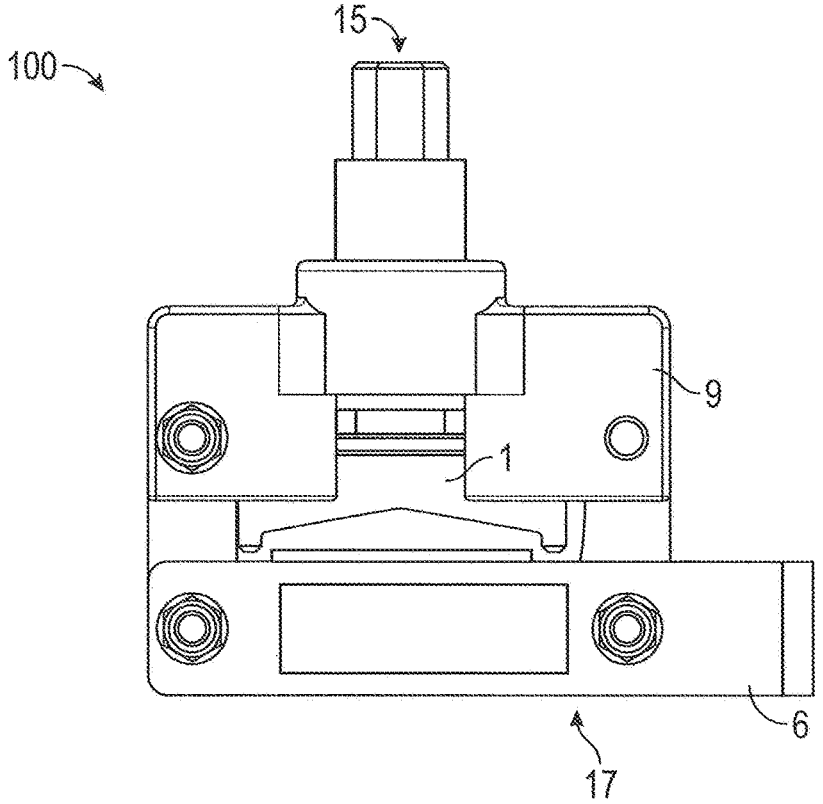
FIGS. 1-3 show different side views of a cutting device according to a preferred embodiment.
Figure 2:
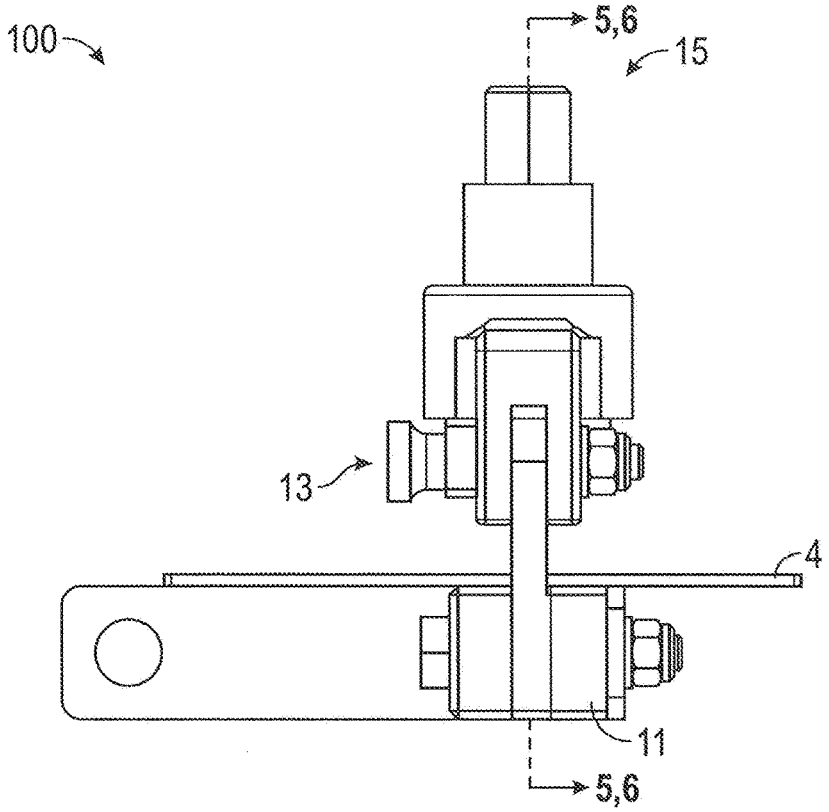
Figure 3:
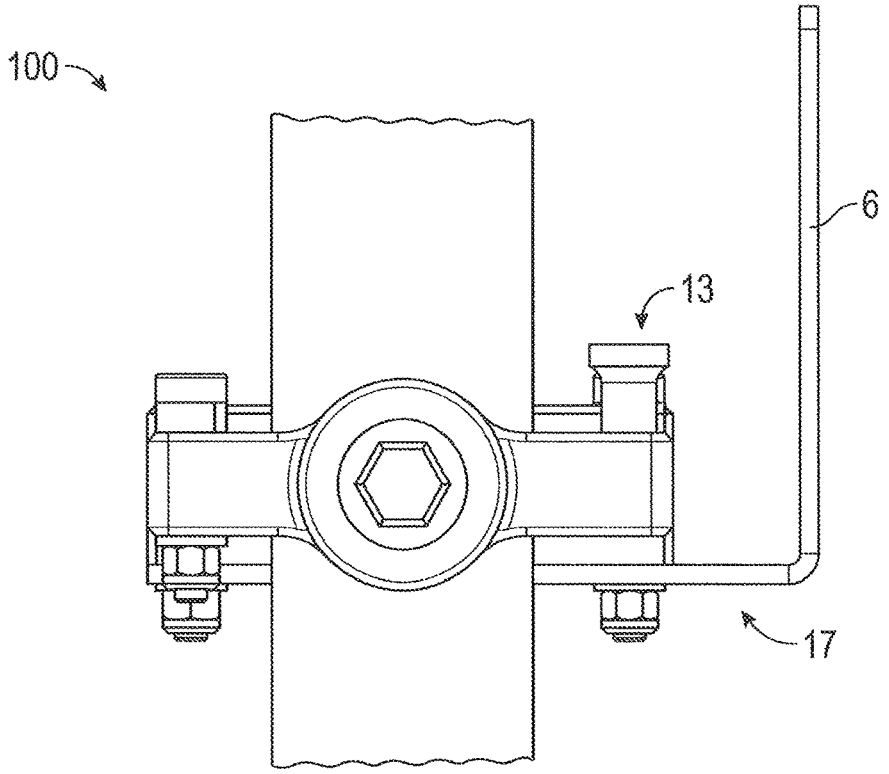
Figure 4:
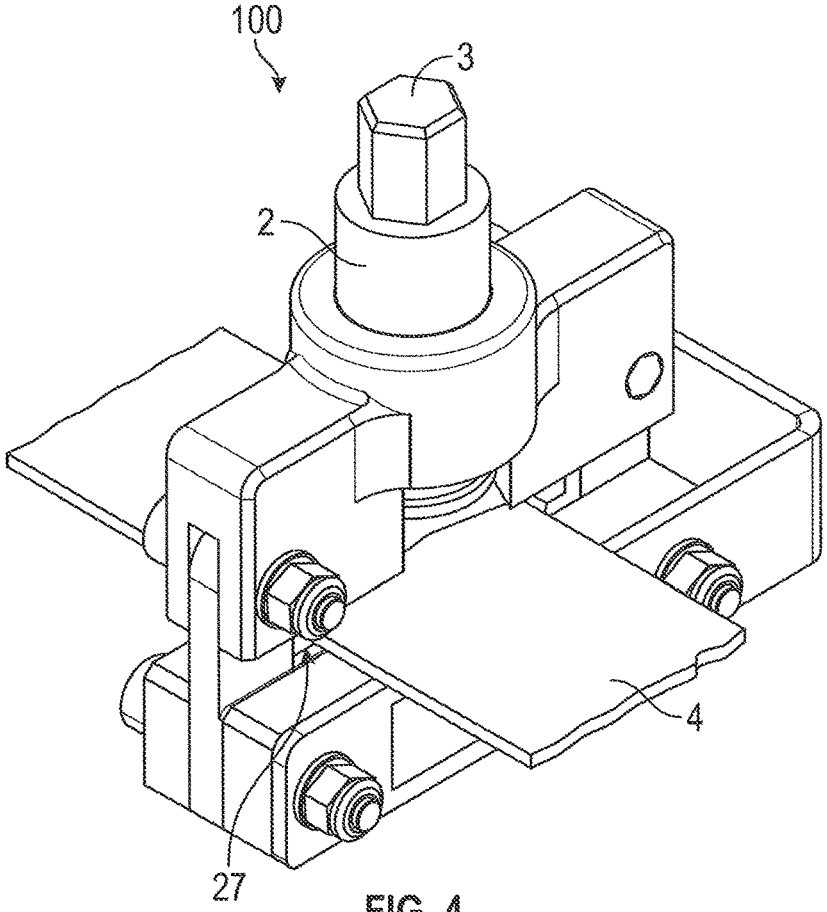
FIG. 4 shows a schematic three-dimensional view on the cutting device of FIGS. 1-3.

The cutting device 100 shown in FIGS. 1-4 comprises a cutting base 11 and a cutting head 9 pivotably mounted to the cutting base 11. FIG. 1 illustrates a frontal view of the cutting head 9, which comprises a blade 1 coupled to a drive mechanism 15. The drive mechanism controls the position of the blade 1 such that the blade 1 can move between an extended position and a retracted position. FIGS. 2 and 3 are side and top views of the cutting device 100 illustrating that the cutting head 9 can be locked into the cutting base 11 (e.g. the retracted or closed position) by a locking device 13. In one embodiment, the locking device 13 is comprised of a locking pin on the cutting base 11, which engages with a recess on the cutting head 9 to secure the cutting base 11 to the cutting head 9.

The cutting device 100 is portable and comprises a handle 17, as seen in FIGS. 1 and 3. The handle 17 may be mounted to the cutting base 11 and further comprises an elongate portion 6 which can either be held manually or by a chuck or comparable device.

The drive mechanism 15 of FIGS. 1 and 2 comprises a drive spindle 2 which is bi-directionally movable and engages along a correspondingly formed thread 7 in the cutting head 9. By rotating the drive spindle 2 in a first direction, e.g. clockwise, the drive spindle 2 moves the blade 1 downwards, from the retracted position towards the extended position, during which the blade 1 cuts a belt 4 positioned on the cutting base 11. Rotating the drive spindle 2 in the opposite direction, e.g. counter-clockwise, moves the blade 1 away from the extended position back into the retracted position. In other words, the drive spindle is configured to actively drive the cutting blade both in a cutting direction and in a release direction.

In order to accomplish the movement of extending and retracting the blade 1, the drive spindle 2 comprises a torque input geometry 3 on one end portion. The torque input geometry 3 may be a polygonal recess or polygonal projection configured to accept torque from a correspondingly shaped tool so that the drive spindle 2 rotates and drives the blade 1 bi-directionally, as described above. As seen in FIG. 3, an ideal embodiment of the torque input geometry 3 is a hexagonal projection that is adapted for being engaged by a manual wrench, or even more preferably, a motorized wrench, such as an impact wrench. In another preferred embodiment, the input geometry may be configured as a male or female Torx® or Torx Plus® profile.

The connecting element 8 is also positioned along the formed thread 7 in the cutting head, so that as the drive spindle moves between the two positions, the formed thread 7 provides further guidance of the drive spindle 2.

Figure 5:
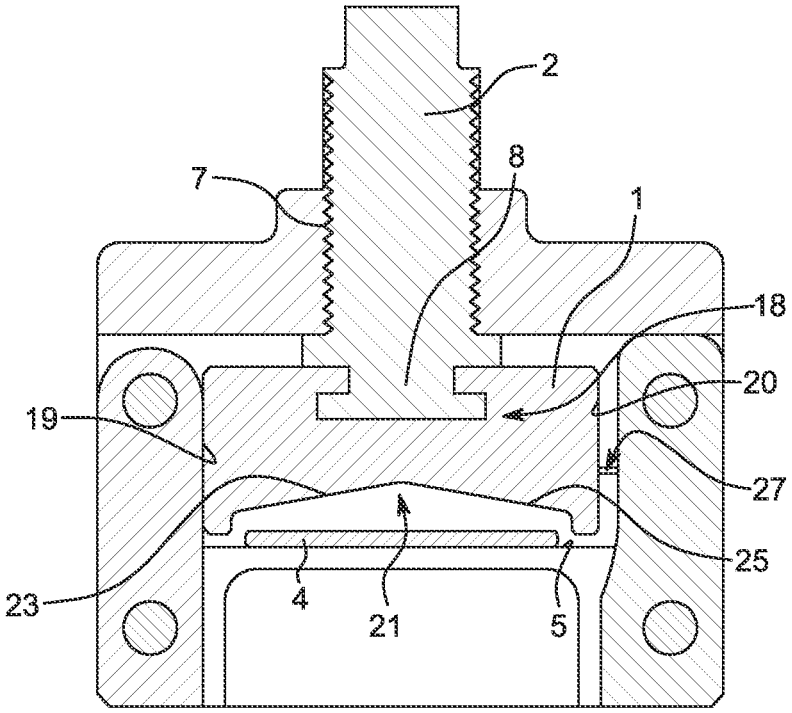
FIG. 5 shows a cross-sectional view along line A-A of FIG. 2 in a first state of movement from the retracted position.

In order to provide a reliable support for the cutting blade 1, the drive spindle 2 further comprises a connecting element 8 positioned opposite of the torque input geometry 3. FIG. 5 shows that the drive spindle's connecting element 8 engages a correspondingly formed connecting element 18 on the blade 1 to form a positive connection.

Figure 6:
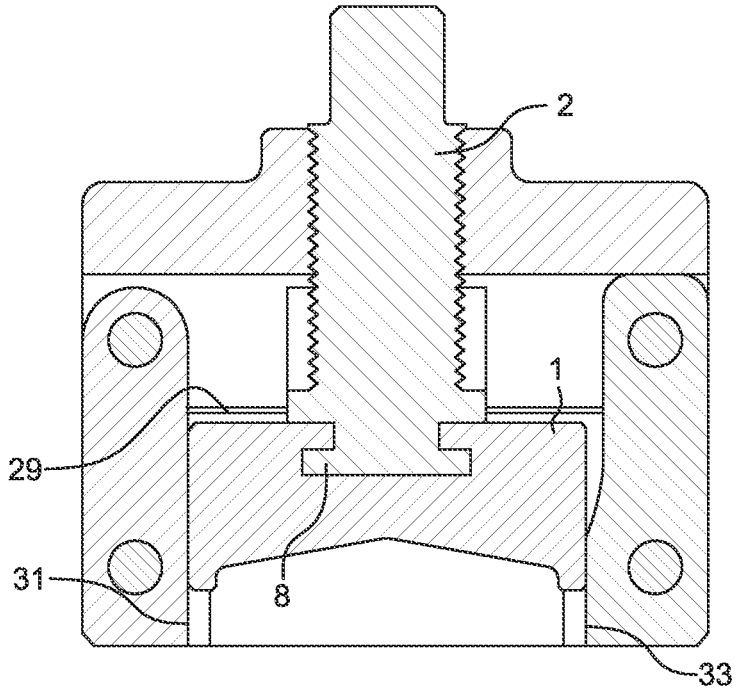
FIG. 6 shows the cross-sectional view of FIG. 5 in a second state of movement towards the extended position.

The blade 1 is adapted to cut a through a belt 4, (e.g. a wire-reinforced flat belt) positioned on the cutting base 11 when the cutting head moves from its retracted position into its extended position FIGS. 5 and 6 illustrate the blade geometry having a first and second lateral side 19, 20 and a center portion 21 in between the first and second lateral sides 19, 20. The blade 1 extends further towards the extended position in the vicinity of the lateral sides 19, 20 than in the center portion 21. The blade 1 has at least one cutting edge 25 that is oriented non-perpendicularly to the direction of the blade's movement between the retracted and extended positions. In an embodiment, the blade further comprises a first and a second blade section 23, 25, the blade sections being angled oppositely with respect to one another and being oriented non-perpendicularly to the direction of movement of the blade.

The cutting base 11 comprises a slit 27 in the plane shown in FIGS. 5 and 6. The slit is delimited by two longitudinal edges 29 which act as stationary edges against is the blade 1 and two lateral sides 31, 33 which are opposite one another and which allow the blade 1 to pass through and also act as guiding means for the blade 1 when moving into the extended position shown. The stationary edges also provide an abutment for the belt 4 as it is positioned on the cutting base 11. As the blade 1 moves from its retracted position to the extended position, the blade 1 contacts and cuts the belt 4 from the belt's periphery to its center, Conditional language used herein, such as, among others, "can," "could," "might," "may," "e.g." and the like, unless specifically stated otherwise, or otherwise understood within the context as used, is generally intended to convey that certain embodiments include, while other embodiments do not include, certain features, elements, and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having" and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some or all of the elements in the list.

While certain example embodiments have been described, these embodiments have been presented by way of example only and are not intended to limit the scope of the inventions disclosed herein. Thus, nothing in the foregoing description is intended to imply that any particular feature, characteristic, step, or component is necessary or indispensable. Indeed, the novel methods and systems described herein may be embodied in a variety of other forms; furthermore, various omissions, substitutions and changes in the form of the methods and systems described herein may be made without departing from the spirit of the inventions disclosed herein. The accompanying claims and their equivalents are intended to cover such forms or modifications as would fall within the scope and spirit of certain of the inventions disclosed herein.

The invention claimed is:

1. A portable belt cutting device, comprising:

a cutting head mounted to a cutting base;

a cutting blade configured to cut a belt, the cutting blade moveably arranged on the cutting head and supported by the cutting head such that the cutting blade is moveable between a retracted position and an extended position, the cutting blade comprising a front side, an opposite backside, a first blade section and a second blade section, a first lateral side, a second lateral side opposite the first lateral side, and a center portion extending between the first lateral side and the second lateral side, wherein the first blade section and the second blade section are angled oppositely to one another and project further towards the extended position at the first lateral side and the second lateral side than in the center portion such that upon contact between the belt and the cutting blade, the belt is cut from its periphery towards its center;

a first edge located adjacent the front side of the cutting blade, a second edge located adjacent the back side of the cutting blade, the first edge and the second edge each fixed relative to the cutting base and configured to abut the belt when the cutting blade cuts the belt;

wherein the cutting head comprises a drive spindle for moving the cutting blade from the retracted position towards the extended position, in which position the cutting blade severs the belt, wherein the drive spindle comprises a connecting element formed on an end portion of the drive spindle as one piece part, and the connecting element is rotatable with, and directly coupled to, a correspondingly formed connecting element of the cutting blade, wherein the correspondingly formed connecting element and the cutting blade are formed as one piece part comprising the cutting blade such that the cutting blade is driven by the drive spindle to move in both directions between the retracted position and the extended position.

2. The cutting device of claim 1, the connecting element on the drive spindle, and the connecting element on cutting blade form a connection with each other when engaged.

3. The cutting device of claim 1, wherein:

the drive spindle engages a thread formed in the cutting head, the spindle being bi-directionally moveable relative to said thread, and the drive spindle comprises a second end portion opposite of a first end portion, the second end portion comprising a torque input geometry.

4. The cutting device of claim 3, wherein the torque input geometry is formed as a polygonal recess or polygonal projection, said recess or said projection being formed to accept correspondingly shaped male or female tools for applying torque, in both rotational directions.

5. The cutting device of claim 3, wherein the torque input geometry is formed as a male hexalobular pattern, or a female hexalobular pattern.

6. The cutting device of claim 1, further comprising a cutting base, the cutting head being mounted to the cutting base, and the cutting base comprising a slit which is dimensioned to allow the cutting blade to pass through when moving between the retracted position and the extended position, the first and second edges being opposite longitudinal edges of the slit.

7. The cutting device of claim 1, further comprising a locking unit for securing the cutting head to the cutting base when in a closed position.

8. The cutting device of claim 7, wherein the locking unit comprises a locking pin mounted to the cutting base, and the cutting head comprises a recess, said recess being dimensioned to accept the locking pin when in the closed position.

9. The cutting device of claim 1, further comprising a handle portion.

10. The cutting device of claim 9, wherein the handle portion is mounted to the cutting base, the handle comprising an elongate portion extending away from the cutting base.

11. The cutting device of claim 1, wherein the blade comprises at least one cutting edge, said cutting edge being oriented non-perpendicularly to the direction of movement of the cutting blade between the retracted position and the extended position.

12. The cutting device of claim 11, wherein the blade comprises a first blade section and a second blade section, the first and second blade sections being angled oppositely to one another;

wherein the cutting blade comprises a first lateral side and a second lateral side opposite the first lateral side, and a center portion extending between the first and second lateral sides, and wherein the first and second blade sections project further towards the extended position at the lateral sides than in the center portion such that upon contact between belt and blade, the belt is cut from its periphery towards its center.

* * * * *